United States Patent [19]

Neff

[11] 4,100,519

[45] Jul. 11, 1978

[54] ALIGNMENT MEANS FOR A MOVEABLE POLE-PLUNGER ASSEMBLY

[75] Inventor: James A. Neff, Bloomfield Township, Oakland County, Mich.

[73] Assignee: MAC Valves, Inc., Wixom, Mich.

[21] Appl. No.: 645,915

[22] Filed: Dec. 31, 1975

[51] Int. Cl.[2] ..... H01F 7/08

[52] U.S. Cl. ..... 335/262; 335/265

[58] Field of Search ..... 335/259, 260, 262, 264, 335/265

[56] References Cited

U.S. PATENT DOCUMENTS

| | | | |
|---|---|---|---|
| 2,692,354 | 10/1954 | Fisher | 335/264 X |
| 3,713,059 | 1/1973 | Tada | 335/259 |
| 3,800,251 | 3/1974 | Usui et al. | 335/262 X |
| 3,805,099 | 4/1974 | Kelly | 335/259 X |

*Primary Examiner*—George Harris
*Attorney, Agent, or Firm*—Robert G. Mentag

[57] ABSTRACT

A solenoid for operating various devices, such as a reversing valve, and which includes a C-frame having a first non-magnetic bushing mounted in the bight portion of the C-frame. A coil assembly is removably mounted in the C-frame and is retained therein by a flux plate which is snapped in place between the outer ends of the legs of the C-frame and retained by a friction fit. The coil assembly is provided with retainer members that seat in retainer notches in the C-frame bight portion and the flux plate, for retaining the coil assembly against movement. A cylindrical, non-magnetic core guide is mounted axially through the coil assembly and has slidably mounted therein a solenoid plunger and a pole piece. A second non-magnetic bushing is mounted in the flux plate. The solenoid plunger has a reduced diameter outer end which is slidably mounted in the first bushing, and the pole piece has a reduced diameter outer end which is slidably mounted through the second bushing. A close tolerance is maintained between the inner diameter of the core guide and the outer diameters of the solenoid plunger and the pole piece, while a large tolerance is provided between the coil assembly and the core guide to permit the combination or assembly of the core guide, the solenoid plunger and the pole piece to float within the coil assembly. An operating shaft is slidably mounted through the pole piece and engages the inner end of the solenoid plunger. A spring has one end operatively mounted against the outer face of the flux plate and the other end attached to the pole piece for normally biasing the floating pole piece into an initial position.

15 Claims, 5 Drawing Figures

ALIGNMENT MEANS FOR A MOVEABLE POLE-PLUNGER ASSEMBLY

SUMMARY OF THE INVENTION

This invention relates generally to solenoids, and more particularly, to a solenoid adapted for use in operating a valve spool, and like members.

Heretofore, solenoids having spring-biased pole pieces to overcome tolerance problems in valves have been provided. An example of such prior art solenoids is disclosed in U.S. Pat. No. 3,538,954. A disadvantage of such prior art solenoids is that they are not self-contained, and the parts thereof must be taken out and inserted separately when maintenance and repair operations are required. The handling of the many parts of such prior art solenoids results in costly and time consuming maintenance and repair operations. A further disadvantage of such prior art solenoids is that they are noisy because of mis-alignment between the moving parts thereof. In view of the foregoing, it is an important object of this invention to provide a novel and improved solenoid which overcomes the aforementioned disadvantages of the prior art solenoids.

It is another object of the present invention to provide a novel and improved solenoid that is self-contained, and which can be inserted and removed from a valve construction, or the like, as a compact unit so as to reduce maintenance and repair time, and the cost of the same.

It is still another object of the present invention to provide a novel and improved solenoid which is constructed and arranged to maintain the alignment of the solenoid plunger and movable pole piece, and thus eliminate noises due to misalignment of said parts.

It is a further object of the present invention to provide a novel and improved solenoid which has a floating tubular guide member for maintaining alignment of the solenoid plunger and a spring biased, movable pole piece.

It is still a further object of the present invention to provide a novel and improved solenoid which includes a coil assembly retained in a support means, and wherein a solenoid plunger and a movable pole piece are guided by the support means, and a floating tubular guide member maintains alignment of the plunger and movable pole piece.

Other objects, features and advantages of this invention will be apparent from the following detailed description, appended claims, and the accompanying drawings.

DETAILED DESCRIPTION OF THE PREFERRED EMBODIMENT

Figure 1:
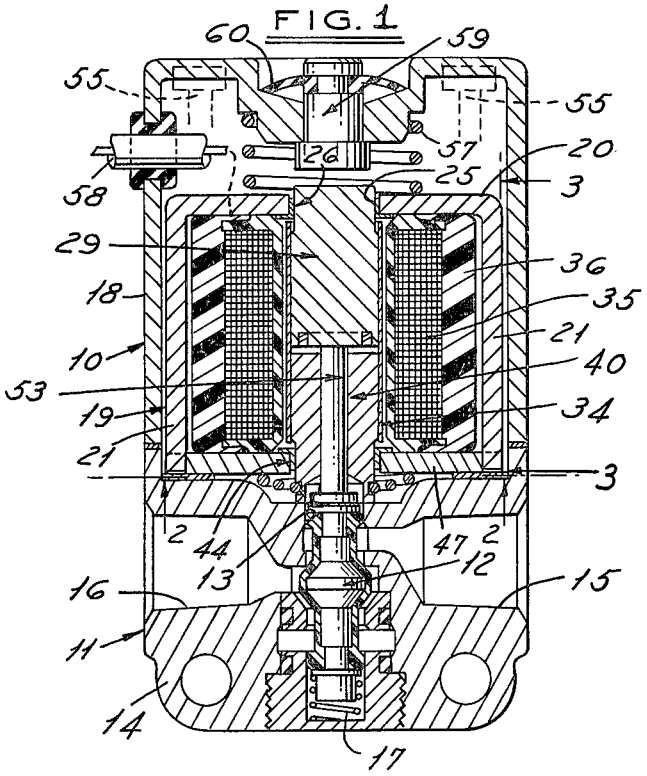
FIG. 1 is an elevation section view of a reversing valve embodying a solenoid made in accordance with the principles of the present invention.

Referring now to the drawings, and in particular to FIG. 1, the numeral 10 generally designates a solenoid and cover assembly made in accordance with the principles of the present invention. The numeral 11 generally designates a three-way reversing valve operated by the solenoid assembly 10. However, it will be understood that the solenoid of the present invention may be employed to operate other types of solenoid-operated reversing valves, as for example, a two-way reversing valve or a four-way reversing valve. The solenoid of the present invention is adapted for use in any application wherein compensation is required for tolerances between a first operative position and a second operative position of a valve stem or other member movable by a solenoid.

The numeral 12 generally designates a poppet stem which is movably mounted in a valve stem bore 13 formed through a valve body 14. The valve 11 includes an inlet or supply port 15 that communicates through the valve stem bore 13 with a fluid delivery or cylinder port 16. A spring 17 normally biases the poppet stem 12 upwardly to a first position shown in FIG. 1 to block fluid flow between the inlet port 15 and the delivery port 16, and to connect the delivery port 16 to an exhaust port (not shown). The solenoid assembly 10 functions to move the poppet stem 12 downwardly to a second position to connect the inlet port 15 with the delivery port 16 and block fluid flow to the exhaust port. A detailed description of the structure and operation of a valve similar to the valve 11 may be found in U.S. Pat. No. 3,538,954.

Figure 2:
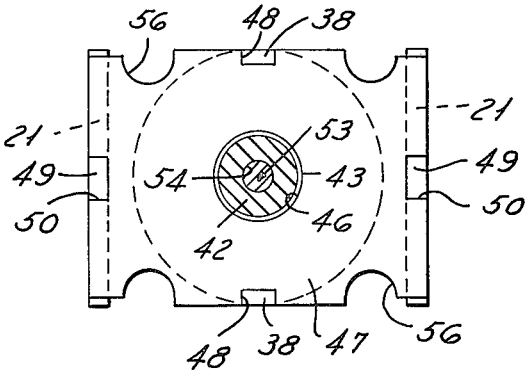
FIG. 2 is a bottom view of the solenoid illustrated in FIG. 1, taken along the line 2—2 thereof, and looking in the direction of the arrows.
Figure 3:
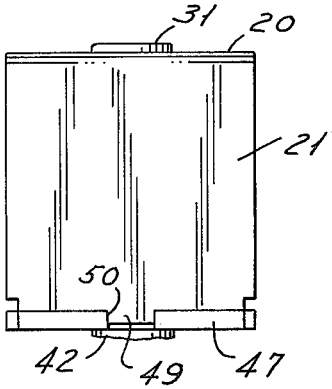
FIG. 3 is a right side elevation view of the solenoid illustrated in FIG. 1, taken along the line 3—3 thereof, and looking in the direction of the arrows.
Figure 4:
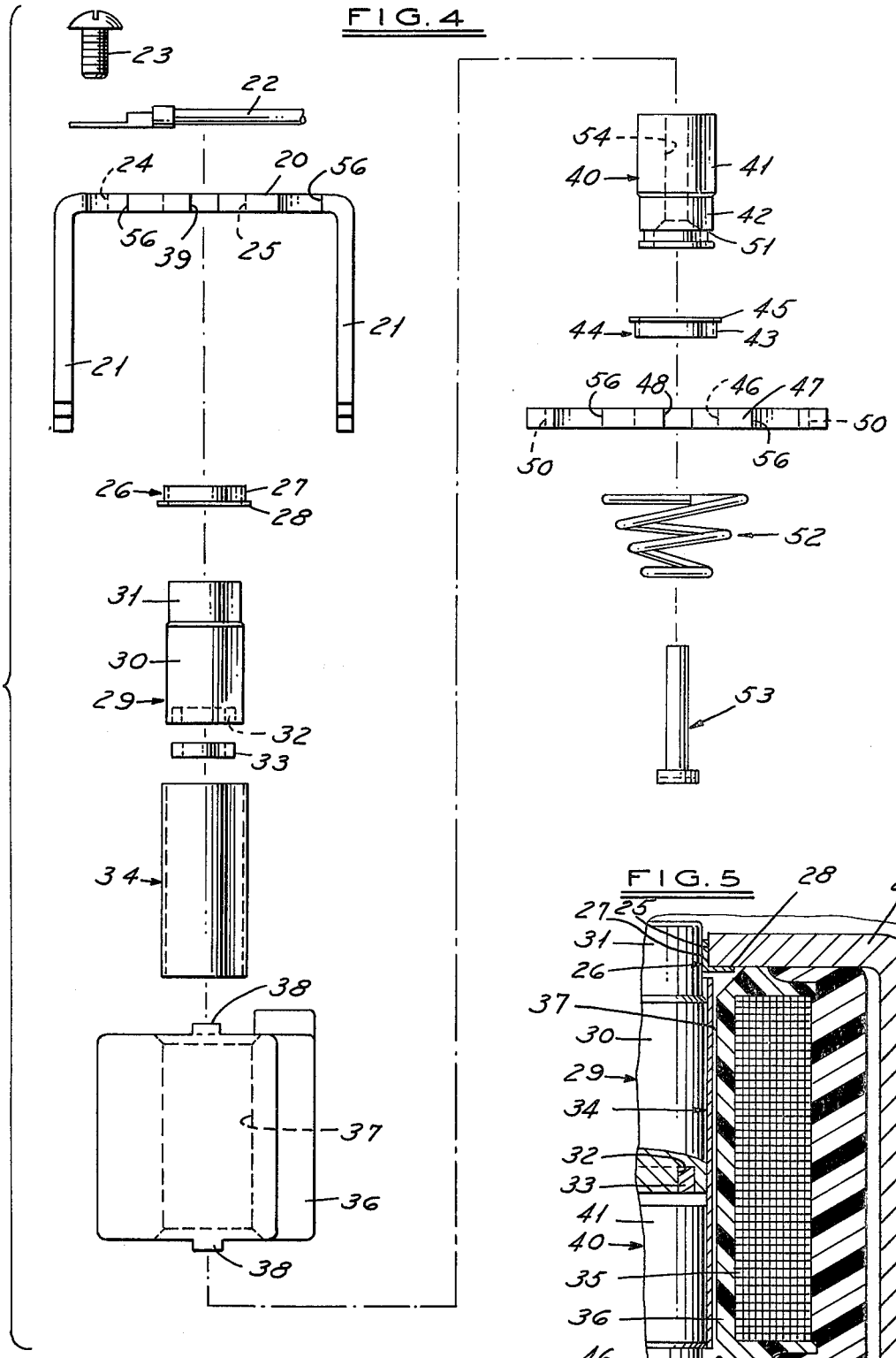
FIG. 4 is an exploded view of the solenoid illustrated in FIG. 1, and showing the assembly of the various parts of the solenoid.

As shown in FIGS. 1 through 4, the solenoid assembly 10 includes a cover 18 which is rectangular in transverse cross section. The cover 18 is telescopically mounted over the solenoid, which is generally indicated by the numeral 19. The solenoid 19 includes a "C" shaped coil assembly support frame that has a transverse plate or bight portion 20, and a pair of integral side plates or legs 21. As shown in FIG. 4, a ground wire 22 is connected by a suitable screw 23 to the support frame plate 20, which is provided with a hole 24 for the reception of the screw 23.

The support frame transverse plate 20 is provided with a central bore 25 into which is slidably mounted, within a close tolerance, the cylindrical body 27 of a bushing, generally indicated by the numeral 26. The bushing 26 includes an integral flange 28 that seats against the inner face of the frame plate 20.

Figure 5:
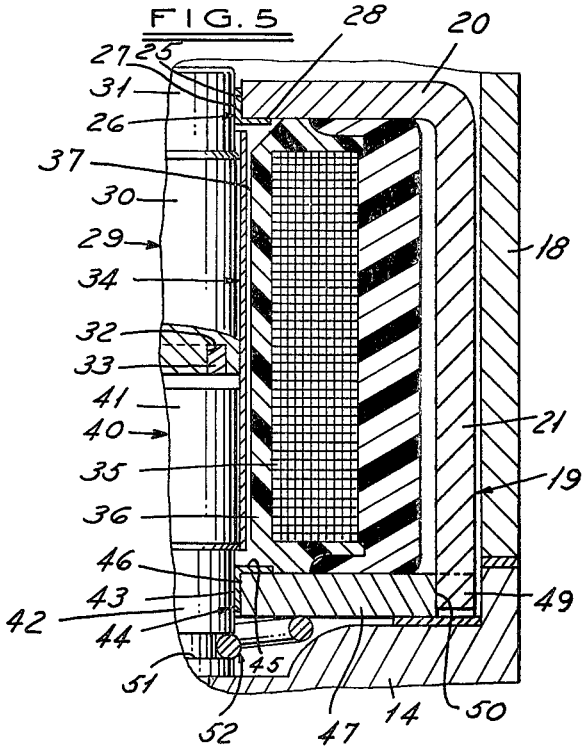
FIG. 5 is an enlarged, fragmentary, elevation section view of the solenoid illustrated in FIG. 1, and similar to FIG. 1.

A solenoid plunger or armature is generally indicated by the numeral 29 in FIGS. 1, 4 and 5. The solenoid plunger 29 is cylindrical in shape and has a main body portion 30 and a reduced diameter outer end portion 31. As shown in FIGS. 1 and 5, the reduced diameter outer end plunger portion 31 is slidably mounted within a close tolerance through the bushing 26. A shading coil 33 is operatively mounted in the inner end of the plunger body 30.

An open-ended cylindrical or tubular core guide, generally indicated by the numeral 34, is slidably mounted over the plunger 29, within a very close tolerance, between the outer diameter of the plunger body 30 and the inner diameter of the core guide 34. The core guide 34 is made from a suitable non-magnetic material, preferably stainless steel.

As shown in FIG. 1, a coil 35 is operatively mounted in a coil assembly 36. The coil assembly 36 is provided with an axial bore 37 for slidably mounting the coil assembly over the core guide 34. As shown in FIG. 5, a substantial clearance is maintained between the inner diameter of the coil assembly bore 37 and the outer diameter of the core guide. The coil assembly 36 is shown encapsulated in a molded plastic material which is provided with a pair of diametrically disposed integral projections 38 on each end thereof. The projections 38 adjacent the support frame plate 20 seat in a pair of notches 39 (FIG. 4) for retaining that end of the coil assembly against movement relative to the support frame and core guide 34. The coil assembly 36 may also be made as a taped assembly and provided with projections similar to the projections 38.

As best seen in FIG. 4, the solenoid 19 includes a spring biased pole piece, generally indicated by the numeral 40. The pole piece 40 has a cylindrical body portion 41 which is slidably mounted in the core guide 34 with the inner end thereof facing the inner end of the plunger 29. A very close tolerance is maintained between the outer diameter of the pole piece body 41 and the inner diameter of the core guide 34.

As shown in FIG. 5, the outer end 42 of the pole piece 40 is made to a reduced diameter and it is slidably mounted, within a very close tolerance, in the cylindrical portion or body 43 of a bushing 44. The bushing body 43 is seated within a very close tolerance in a central bore 46 formed through a flux plate 47. The bushing 44 has an integral flange 45 that seats against the inner face of the plate 47.

As shown in FIG. 2, the coil assembly projections 38 adjacent the flux plate 47 are seated in notches 48 formed in the plate 47 for retaining the coil assembly against movement relative to the flux plate 47 and the core guide 34. The bushings 26 and 44 are both made from a suitable nonmagnetic material, preferably stainless steel.

The legs 21 of the support frame are bowed inward slightly so that the flux plate 47 can be slidably received within the ends of the frame legs 21 and be held therebetween by a friction fit. As shown in FIGS. 2 and 3, the flux plate 47 is provided at each end with a notch 50 that receives a projection 49 on the end of the adjacent frame leg 21. The flux plate 47 is snapped in place against the legs 21 of the support frame to hold the aforedescribed solenoid parts in a self-retaining assembly which can be quickly and easily removed or inserted as a unit in a valve assembly or the like. The coil assembly 36 is free to move a slight amount within the support frame structure. The spring-biased pole piece 40 is provided with an annular groove 51 around the outer end of the reduced diameter portion 42. One end of a coil spring 52 is retained in the groove 51 and the other end is seated against the outer face of the flux plate 47. The spring 52 functions to bias the pole piece 40 against the valve body 14, and provide a floating pole piece that functions as the pole piece described in said prior U.S. Pat. No. 3,538,954. A valve spool extension 53 is slidably mounted through an axial bore 54 formed through the pole piece 40. The inner end of the spool extension abuts the inner end of the solenoid plunger 29, and the outer end thereof engages the upper end of the poppet stem 12, as shown in FIG. 1.

The solenoid cover 18 is secured to the valve body 14 by any suitable means, as by a pair of suitable machine screws 55 (FIG. 1). The support frame plate 20 is provided with suitable half-round openings along the side edges thereof to allow the screws 55 to pass thereby, and to further retain the solenoid 19 in place. The flux plate 47 has similar openings 56 (FIG. 2). As shown in FIG. 1, a spring 57 is disposed centrally with the cover 18 for biasing the solenoid 19 into position against the valve body 14. The coil 35 is provided with suitable lead wires 58. A manually operated push-button 59 is mounted in the closed end of the cover 18 and is normally biased to an inoperative position by a suitable resilient seal member 60 which also functions to seal the solenoid assembly internally from the outside environment. The resilient seal member 60 may be made from any suitable material, as rubber.

In operation, the solenoid 19 is in the initial position shown in FIG. 1. When it is desired to move the poppet stem 12 downwardly to a second operative position, the solenoid 19 is energized and the plunger 29 is pulled downwardly so as to overcome the force of spring 17. When the poppet stem 12 reaches the second operative position, the movable pole piece 40 is raised upward magnetically, to seat against the lower end of the plunger 29 and effect a magnetic seal between the pole piece 40 and the plunger 29. Upon de-energization of the coil 35, the spring 17 moves the poppet stem 12 back to its initial position shown in FIG. 1.

The solenoid assembly of the present invention provides a core guide 34 which can float so as to align itself and the plunger 29 and pole piece 40. The core guide 34 functions to prevent the plunger 29 and pole piece 40 from moving around so as to prevent noises caused by such movement, especially in an A.C. solenoid. The coil assembly 36 is fixed relative to the support frame, and it cannot interfere with the self-aligning action of the core guide 34. The metal core guide 34 is very stable over a large temperature change range, and it will not bind the plunger 29 and pole piece 40, or restrict their movements. The self-retaining structure of the solenoid assembly permits maintenance and repair operations to be carried out quickly and efficiently.

While it will be apparent that the preferred embodiment of the invention herein disclosed is well calculated to fulfill the objects above stated, it will be appreciated that the invention is susceptible to modification, variation and change.

What is claimed is:

1. In a solenoid assembly, the combination comprising:

(a) a C-shaped support frame having a transverse member and a pair of leg members;

(b) a solenoid coil assembly mounted within said support frame;

(c) a flux plate releasably mounted between said support frame leg members for retaining said coil assembly against endwise movement in said support frame;

(d) mating retainer means on said coil assembly and said support frame for retaining the coil assembly against sidewise movement in said support frame;

(e) a pole piece movably mounted in an axial bore through said coil assembly and being guided for axial movement by a first bushing mounted in said flux plate;

(f) means for normally biasing said pole piece outwardly of said axial bore in said coil assembly;

(g) a solenoid plunger movably mounted in said axial bore in said coil assembly and being guided for axial movement by a second bushing mounted in said support frame transverse member; and, (h) means in said axial bore of said coil assembly and in spaced apart relation to said coil assembly and in close sliding engagement with said solenoid plunger and pole piece for aligning said solenoid plunger and pole piece.

2. A solenoid assembly as defined in claim 1, wherein:

(a) said flux plate is held between said support frame leg members by a friction fit.

3. A solenoid assembly as defined in claim 1, wherein:

(a) said coil assembly is provided with projections, and said support frame transverse member and flux plate are provided with notches for receiving said projections to retain the coil assembly against sidewise movement.

4. A solenoid assembly as defined in claim 1, wherein:

(a) said movable pole piece has an outer end that is guided by said first bushing in said flux plate.

5. A solenoid assembly as defined in claim 1, wherein:

(a) said solenoid plunger has an outer end that is guided by said second bushing in said support frame transverse member.

6. In a solenoid assembly, the combination comprising:

(a) a C-shaped support frame having a transverse member and a pair of leg members;

(b) a solenoid coil assembly mounted within said support frame;

(c) a flux plate releasably mounted between said support frame leg members for retaining said coil assembly against endwise movement in said support frame;

(d) mating retainer means on said coil assembly and said support frame for retaining the coil assembly against sidewise movement in said support frame;

(e) a pole piece movably mounted in an axial bore through said coil assembly and being guided for axial movement by said flux plate;

(f) means for normally biasing said pole piece outwardly of said axial bore in said coil assembly;

(g) a solenoid plunger movably mounted in said axial bore in said coil assembly and being guided for axial movement by said support frame transverse member;

(h) means in said axial bore of said coil assembly and in spaced apart relation to said coil assembly and in close sliding engagement with said solenoid plunger and pole piece for aligning said solenoid plunger and pole piece;

(i) said solenoid plunger having an outer end that is guided by said support frame transverse member;

(j) said flux plate having a bore therethrough;

(k) a first bushing being mounted in said last named bore for the slidable reception of the outer end of said pole piece for guiding the pole piece;

(l) said support frame transverse member having a bore therethrough; and, (m) a second bushing being mounted in said last named bore for the slidable reception of the outer end of said plunger for guiding the plunger.

7. A solenoid assembly as defined in claim 1, wherein:

(a) said movable pole piece has an outer end that is guided by said first bushing in said flux plate;

(b) said solenoid plunger has an outer end that is guided by said second bushing in said support frame transverse member;

(c) said pole piece and solenoid plunger each have a body portion; and (d) a tubular guide member is mounted in the axial bore through said coil assembly and it slidably receives said pole piece and solenoid plunger body portions for maintaining alignment of the same.

8. In a solenoid assembly, the combination comprising:

(a) a C-shaped support frame having a transverse member and a pair of leg members;

(b) a solenoid coil assembly mounted within said support frame;

(c) a flux plate releasably mounted between said support frame leg members for retaining said coil assembly against endwise movement in said support frame;

(d) mating retainer means on said coil assembly and said support frame for retaining the coil assembly against sidewise movement in said support frame;

(e) a pole piece movably mounted in an axial bore through said coil assembly and being guided for axial movement by said flux plate;

(f) means for normally biasing said pole piece outwardly of said axial bore in said coil assembly;

(g) a solenoid plunger movably mounted in said axial bore in said coil assembly and being guided for axial movement by said support frame transverse member;

(h) means in said axial bore of said coil assembly and in spaced apart relation to said coil assembly and in close sliding engagement with said solenoid plunger and pole piece for aligning said solenoid plunger and pole piece;

(i) said movable pole piece having an outer end that is guided by a bushing mounted in said flux plate;

(j) said solenoid plunger having an outer end that is guided by a bushing mounted in said support frame transverse member;

(k) said pole piece and solenoid plunger each having a body portion;

(l) a tubular guide member being mounted in the axial bore through said coil assembly and slidably receiving said pole piece and solenoid plunger body portions for maintaining alignment of the same; and, (m) the tubular guide being free to float within the axial bore through said coil assembly.

9. A solenoid assembly as defined in claim 7, wherein:

(a) the tubular guide is made from a non-magnetic metal.

10. A solenoid assembly as defined in claim 9, wherein:

(a) the tubular guide is made from stainless steel.

11. In a solenoid assembly, the combination comprising:

(a) a C-shaped support frame having a transverse member and a pair of leg members;

(b) a solenoid coil assembly mounted within said support frame;

(c) a flux plate releasably mounted between said support frame leg members for retaining said coil assembly against endwise movement in said support frame;

(d) mating retainer means on said coil assembly and said support frame for retaining the coil assembly against sidewise movement in said support frame;

(e) a pole piece movably mounted in an axial bore through said coil assembly and being guided for axial movement by said flux plate;

(f) means for normally biasing said pole piece outwardly of said axial bore in said coil assembly;

(g) a solenoid plunger movably mounted in said axial bore in said coil assembly and being guided for axial movement by said support frame transverse member;

(h) means in said axial bore of said coil assembly and in spaced apart relation to said coil assembly and in close sliding engagement with said solenoid plunger and pole piece for aligning said solenoid plunger and pole piece;

(i) said movable pole piece having an outer end that is guided by said flux plate;

(j) said solenoid plunger having an outer end that is guided by said support frame transverse member;

(k) said pole piece and solenoid plunger each having a body portion;

(l) a tubular guide member being mounted in the axial bore through said coil assembly and slidably receiving said pole piece and solenoid plunger body portions for maintaining alignment of the same; and, (m) a bushing being mounted in said flux plate for guiding the outer end of said pole piece.

12. In a solenoid assembly, the combination comprising:

(a) a C-shaped support frame having a transverse member and a pair of leg members;

(b) a solenoid coil assembly mounted within said support frame;

(c) a flux plate releasably mounted between said support frame leg members of retaining said coil assembly against endwise movement in said support frame;

(d) mating retainer means on said coil assembly and said support frame for retaining the coil assembly against sidewise movement in said support frame;

(e) a pole piece movably mounted in an axial bore through said coil assembly and being guided for axial movement by said flux plate;

(f) means for normally biasing said pole piece outwardly of said axial bore in said coil assembly;

(g) a solenoid plunger movably mounted in said axial bore in said assembly and being guided for axial movement by said support frame transverse member;

(h) means in said axial bore of said coil assembly and in spaced apart relation to said coil assembly and in close sliding engagement with said solenoid plunger and pole piece for aligning said solenoid plunger and pole piece;

(i) said movable pole piece having an outer end that is guided by said flux plate;

(j) said solenoid plunger having an outer end that is guided by said support frame transverse member;

(k) said pole piece and solenoid plunger each having a body portion;

(l) a tubular guide member being mounted in the axial bore through said coil assembly and slidably receiving said pole piece and solenoid plunger body portions for maintaining alignment of the same; and, (m) a bushing being mounted in said support frame transverse member for guiding the outer end of said solenoid plunger.

13. In a solenoid assembly, the combination comprising:

(a) support means;

(b) a coil assembly retained in said support means;

(c) a movable pole piece having an outer end guided by a bushing mounted in said support means;

(d) a solenoid plunger having an outer end guided by a bushing mounted in said support means;

(e) means for aligning the pole piece and plunger; and, (f) said means for aligning the pole piece and plunger being free to float relative to the coil assembly.

14. A solenoid assembly as defined in claim 13, wherein:

(a) said means for aligning the pole piece and plunger is a tubular guide member.

15. A solenoid assembly as defined in claim 14, wherein:

(a) said pole piece has a body portion slidably mounted in said tubular guide, and said outer end thereof is of an outer diameter smaller than the diameter of said body portion; and, (b) said plunger has a body portion slidably mounted in said tubular guide, and said outer end thereof is of an outer diameter smaller than the diameter of said body portion.

* * * * *